United States Patent [19]

Chen

[11] Patent Number: 4,723,415

[45] Date of Patent: Feb. 9, 1988

[54] DIRECT WATER EVAPORATING COOLING SYSTEM

[76] Inventor: Jen K. Chen, 2033 Joan Dr., Hacienda Heights, Calif. 91745

[21] Appl. No.: 918,331

[22] Filed: Oct. 14, 1986

[51] Int. Cl.[4] ..... F25B 19/00

[52] U.S. Cl. ..... 62/169; 62/171

[58] Field of Search ..... 62/171, 169, 100, 268

[56] References Cited

U.S. PATENT DOCUMENTS

| | | | |
|---|---|---|---|
| 2,050,516 | 8/1936 | Woodard | 62/169 |
| 2,129,098 | 9/1938 | Fetzer | 62/169 |
| 3,695,208 | 10/1972 | Fixler | 62/268 X |
| 3,965,690 | 6/1976 | Berryhill | 62/171 X |

*Primary Examiner*—Harry Tanner

*Attorney, Agent, or Firm*—Gilden & Israel

[57] ABSTRACT

An air and water cooling system includes an evaporator tank partially filled with water with a vacuum pump maintaining a partial vacuum in the tank. A spray of water is directed from a header into the tank, and the partial vacuum effects an evaporation of some of the sprayed water so as to absorb heat from the main pool of water contained within the tank. This cooled water supply may then be pumped through a cooling coil positioned within a heat exchanger, and a flow of air through the heat exchanger will acquire a desired air cooling effect. The water in the cooling coil is then pumped back to the spray header positioned within the evaporator tank to complete the closed cycle. Since the vacuum pump will result in the removal of evaporated water, a float operated water makeup feed is provided to maintain a constant level of water within the evaporator tank.

1 Claim, 1 Drawing Figure

DIRECT WATER EVAPORATING COOLING SYSTEM

BACKGROUND OF THE INVENTION

1. Field of the Invention

The present invention relates to water and air cooling systems, and more particularly pertains to a new and improved direct water evaporating and cooling system which utilizes a vacuum pump to cool water directed through a heat exchanger.

2. Description of the Prior Art

As can be appreciated, traditional air conditioners consume a lot of energy, and they are quite expensive to manufacture and maintain due to the complexity of the compression and condensing cycles associated therewith. To lessen the cost of air conditioning, it is sometimes feasible to utilize cooled water systems which dispense with the use of a compressed gas in an evaporative cycle to achieve a desired heat exchange. In this respect, all cooling cycles are based upon the evaporation of a liquid, such as Freon gas or the like, which then results in an absorption of heat. More specifically, before a liquid can evaporate, heat must be absorbed.

Most cooling cycles rely upon some type of evacuation to assist in the evaporating of a liquid, and further, it is known that water can be evaporated in the presence of a vacuum to effect a desired cooling of a fluid. For example, U.S. Pat. No. 3,563,049 which issued to A. Schnerring on Feb. 16, 1971, discloses an aspirator and circulating cooling apparatus. The aspirator draws a constant vacuum within the circulating cooling system, while a water pump delivers water to the aspirator which is at least partially evaporated by the vacuum effect to a achieve a desired cooling of the main water supply contained within the aspirator.

While this basic concept relating to the evaporation of water in a vacuum environment is known in the prior art, apparently no use has been made of the concept to develop an economical and inexpensive air cooler which could be used in a residence, commercial, industrial or the like. As such, there exists a continuing need for new and improved water and air cooling systems which are of a practical and inexpensive design, and in this respect, the present invention substantially fulfills this needs.

SUMMARY OF THE INVENTION

In view of the foregoing disadvantages inherent in the known types of evaporative water and air cooling systems now present in the prior art, the present invention provides an improved evaporative water and air cooling system that is of a compact and inexpensive design whereby the same can be practically and efficiently used within a building or the like. As such, the general purpose of the present invention, which will be described subsequently in greater detail, is to provide a new and improved direct water evaporator and cooling apparatus which has all the advantages of the prior art water and air cooling apparatuses and none of the disadvantages.

To attain this, the present invention utilizes an evaporator tank which may be partially filled with water within a closed cycle fluid circulating system. One or more headers may be provided within the evaporator tank with these headers including a plurality of spray nozzles that continually direct a spray of water into the main water supply. A vacuum pump attached to the evaporator tank maintains a partial vacuum in the tank at all times, with the result that a portion of the sprayed water will evaporate. The evaporating water absorbs heat from the main pool of water, thereby to effect a cooling thereof, and a water circulating pump then draws the water from the tank through a cooling coil positioned within a heat exchanger. A flow of air through the heat exchanger will result in heat being absorbed by the water in the cooling coil, with a consequent cooling of the air, and the warmed water is then redirected back to the evaporator tank to be discharged therein through the header spray nozzles.

As is apparent, the constant removal by the vacuum pump of evaporated water will result in a lowering of the level of the water within the evaporator tank, and accordingly, a float-operated makeup water feed is provided to maintain a constant water level within the tank. The makeup feed is also attached to a header spray system which results in all makeup feed water being sprayed into the tank in the same manner as the water being returned from the heat exchanger. The invention may further include a check valve positioned proximate the vacuum pump to prevent a loss of vacuum within the tank, as well as a return of water which may condense within the pump and its associated conduits.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved direct water evaporating cooling system which has all the advantages of the prior art direct water evaporating cooling systems and none of the disadvantages.

It is another object of the present invention to provide a new and improved direct water evaporating cooling system which may be easily and efficiently manufactured and marketed.

It is a further object of the present invention to provide a new and improved direct water evaporating cooling system which is of a durable and reliable construction.

An even further object of the present invention is to provide a new and improved direct water evaporating cooling system which is susceptible of a low cost of manufacture with regard to both materials and labor, and which accordingly is then susceptible of low prices of sale to the consuming public, thereby making such direct water evaporating cooling system economically available to the buying public.

Still yet another object of the present invention is to provide a new and improved direct water evaporating cooling system which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

The FIGURE is a perspective view of a direct water evaporating cooling system comprising the present invention.

DESCRIPTION OF THE PREFERRED EMBODIMENT

Figure 1:
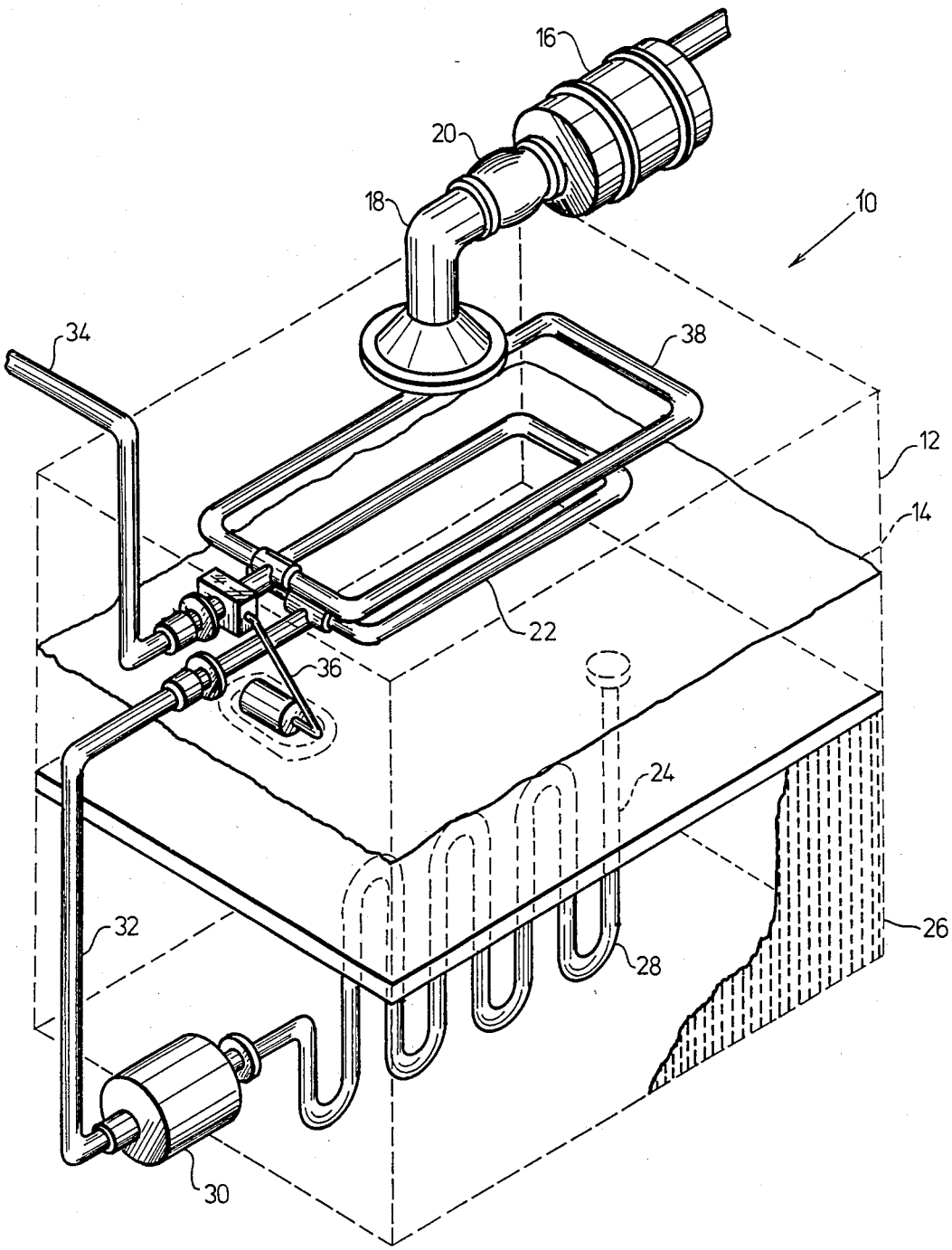

With reference now to the FIGURE, a new and improved water evaporating cooling system embodying the principles and concepts of the present invention and generally designated by the reference numeral 10 will be described.

More specifically, it will be noted that the water evaporating cooling system 10 includes a sealed evaporator tank 12 having a supply of water 14 contained therein. The sealed tank 12 has a vacuum pump 16 operably attached thereto by a conventional conduit 18 and is operable to maintain a partial vacuum within a tank at all times. A one-way check valve 20 is provided on the intake side of the vacuum pump 16, with this valve preventing the return of air and condensed water to the tank 12 in the event of pump shutdown.

A first water spray header 22 is fixedly secured within the tank 12 and is positioned above the surface of the water 14. The header 22 includes a plurality of small spray nozzles on a bottommost surface thereof, with these spray nozzles operating to provide a constant spray of water into the tank.

A supply of water 14 may be drawn out of the tank 12 by a conduit 24 fluidly connected to a side or bottom section of the tank in a conventional manner. The conduit 24 is directed through a heat exchanger 26 which may be either proximate the evaporator tank 12 or which may be located at a remote location. The conduit 24 is formed into a plurality of cooling coils 28 within the heat exchanger 26 so as to provide a maximum surface area for contact with a flow of air being directed through the heat exchanger. A water circulating pump 30 is then provided within the closed conduit system to effect a return of the water 14 through a further conduit 32 to the aforementioned water spray header 22, thereby completing the closed fluid flow cycle.

Inasmuch as the vacuum pump 16 will continually draw some water 14 out of the evaporator tank 12, so as to reduce the amount of water contained within the closed system, a water makeup feed line 34 is provided. As illustrated, the water conduit 34 is sealingly connected to evaporator tank 12 and includes a float valve 36 positioned within the tank to control the level of the water therein. Depending upon the positioning of the float valve 36, makeup feed water is delivered to a second water spray header 38 which also has a plurality of bottommost located spray nozzles for effecting a spray of water within the tank 12.

OPERATION

With respect to the manner of operation of the present invention, it can be appreciated that the vacuum pump 16 will at all times maintain a partial vacuum within the evaporator tank 12. Water spray being directed out of the water spray header 22 will condense in the main water supply 14 contained within the evaporator tank 12; however, the partial vacuum maintained within the tank will result in some of the water spray evaporating or boiling at approximately 45 degrees F. or above. As in well known in the art, the evaporating water will absorb heat from the main water supply 14, which results in the main water supply being chilled to a typical temperature of 50 degrees F. or above. The chilled water is then directed to the cooling coil 28 by the water circulating pump 30, and the air directed over the cooling coils will then give up heat to warm the water, while in turn being itself cooled to achieve the desired ambient air cooling affect. The warmed water in the cooling coil is then directed back to the first water spray header 22 to complete the closed cycle.

As the vacuum pump 16 draws off evaporated water, the main supply of water 14 will be reduced which results in the float valve 36 being operated to permit a makeup feed supply of water through the conduit 34. The makeup feed water is directed through a second spray header 38 thereby to permit some of the makeup feed water to also be evaporated to improve the cooling efficiency of the unit.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water evaporating cooling system, comprising:

a. an evaporator tank means, said tank means enclosing a space containing a water supply and partial vacuum when said cooling system is in operation;

b. a vacuum pump means for maintaining air pressure at less than one atmosphere in said evaporator tank means, said vacuum pump means being operably attached to said evaporator tank means via a first conduit fluidly connecting said vacuum pump means with said enclosed space within said evaporator tank means;

c. a one-way valve means positioned between said vacuum pump means and said evaporator tank means in said 1st conduit, said one-way valve means preventing a return of water and air to said evaporator tank means, when an increase in air pressure is experienced in said 1st conduit d. a heat exchanger means through which said water in said evaporator tank means is propelled by a water pump means, said heat exchanger means being positioned proximate said evaporator tank means, and said heat exchanger means including a cooling coil through which said water is directed, said cooling coil serving to cool an exogenous air supply;

e. a first spray means for receiving a return supply of said water from said heat exchanger means and delivering said water as a spray into said enclosed space in said evaporator tank means, said partial vacuum promoting evaporation of said water by decreasing the ratio of air pressure to vapor pressure, said spray means promoting evaporation of said water by increasing the surface area of said water, said evaporation having a cooling effect on said water;

f. a water supply maintenance means for maintaining a constant supply of water within said evaporator tank means, said water supply maintenance means comprising a second conduit in fluid connection with an exogenous water source and serving to deliver water from said exogenous water source to said evaporator tank means, said water supply maintenance means further comprising a valve means, said valve means serving to prevent said delivery of said exogenous water to said evaporator tank means when said water supply in said evaporator tank means attains a predetermined volume, said water supply maintenance means further comprising a second spray means in fluid connection with said second conduit, said second spray means being positioned within said enclosed space within said evaporation tank means, said second spray means serving to promote the evaporation of said water from said exogenous water source, thereby tending to counteract a warming effect from the introduction of said water from said exogenous water supply into said evaporation tank means.

* * * * *